US011293371B2

(12) United States Patent
Oki et al.

(10) Patent No.: US 11,293,371 B2
(45) Date of Patent: Apr. 5, 2022

(54) FUEL INJECTION CONTROL DEVICE

(71) Applicant: Hitachi Automotive Systems, Ltd., Hitachinaka (JP)

(72) Inventors: Kotaro Oki, Hitachinaka (JP); Osamu Mukaihara, Hitachinaka (JP); Fumihiro Itaba, Hitachinaka (JP); Akira Iizuka, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 0 days.

(21) Appl. No.: 15/734,429

(22) PCT Filed: Jul. 4, 2019

(86) PCT No.: PCT/JP2019/026563
§ 371 (c)(1),
(2) Date: Dec. 2, 2020

(87) PCT Pub. No.: WO2020/017335
PCT Pub. Date: Jan. 23, 2020

(65) Prior Publication Data

US 2021/0164414 A1 Jun. 3, 2021

(30) Foreign Application Priority Data

Jul. 20, 2018 (JP) ..... JP2018-137156

(51) Int. Cl.
*F02D 41/34* (2006.01)
*F02D 41/20* (2006.01)
(Continued)

(52) U.S. Cl.
CPC ..... *F02D 41/34* (2013.01); *F02D 41/20* (2013.01); *F02D 41/247* (2013.01);
(Continued)

(58) Field of Classification Search
CPC ..... F02D 41/34; F02D 41/20; F02D 41/247; F02D 2041/2055; F02D 2041/2058;
(Continued)

(56) References Cited

U.S. PATENT DOCUMENTS 9,714,626 B2 * 7/2017 Hatanaka ..... F02M 63/0017
10,161,339 B2 * 12/2018 Kusakabe ..... F02D 41/20
(Continued)

FOREIGN PATENT DOCUMENTS

JP 2004-270531 A 9/2004
JP 2014-152697 A 8/2014
(Continued)

OTHER PUBLICATIONS

International Search Report with English translation and Written Opinion issued in corresponding application No. PCT/JP2019/026563 dated Oct. 29, 2019.

*Primary Examiner* — Phutthiwat Wongwian
*Assistant Examiner* — Susan E Scharpf
(74) *Attorney, Agent, or Firm* — Foley & Lardner LLP

(57) ABSTRACT

Provided is a technique for identifying a variation in an injection amount by estimating a valve opening start timing in an extremely small injection region of a half lift region. Therefore, a fuel injection control device according to the present invention estimates a valve opening start timing of a fuel injection valve by referring to a characteristic of a reference fuel injection valve acquired in advance.

13 Claims, 11 Drawing Sheets

(51) Int. Cl.
*F02D 41/24* (2006.01)
*F02D 41/28* (2006.01)
*F02M 51/06* (2006.01)

(52) U.S. Cl.
CPC ..... *F02D 2041/2055* (2013.01); *F02D 2041/2058* (2013.01); *F02D 2041/286* (2013.01); *F02D 2200/0602* (2013.01); *F02M 51/0685* (2013.01)

(58) Field of Classification Search
CPC ..... F02D 2041/286; F02D 2200/0602; F02M 51/0685
See application file for complete search history.

(56) References Cited

U.S. PATENT DOCUMENTS 10,634,083 B2 * 4/2020 Kusakabe ..... F02D 41/008
10,704,486 B2 * 7/2020 Kusakabe ..... F02M 61/10
11,181,067 B1 * 11/2021 Kato ..... F02D 41/26
2015/0377176 A1 * 12/2015 Hatanaka ..... F02M 51/061 137/554
2018/0003120 A1 * 1/2018 Nakano ..... F02D 41/36
2018/0010545 A1 * 1/2018 Mukaihara ..... F02D 41/221
2018/0017005 A1 * 1/2018 Kusakabe ..... F02D 41/3064
2018/0283306 A1 * 10/2018 Kusakabe ..... F02D 41/402
2019/0085783 A1 * 3/2019 Kusakabe ..... F02D 41/401

FOREIGN PATENT DOCUMENTS

JP 2014-234923 A 12/2014
JP 2016-196893 A 11/2016
JP 2018-059511 A 4/2018
WO WO-2016/136394 A1 9/2016

* cited by examiner

FUEL INJECTION CONTROL DEVICE

TECHNICAL FIELD

The present invention relates to a control device for a fuel injection valve which injects and supplies fuel to an internal combustion engine.

BACKGROUND ART

Due to the recent tightening of automobile fuel consumption and exhaust regulations, it is required to simultaneously achieve low fuel consumption and high output of internal combustion engines and to be suitable for a wide operating range of internal combustion engines. As one of means for achieving this, it is required to expand a dynamic range of a fuel injection valve. In order to expand the dynamic range of the fuel injection valve, it is necessary to improve dynamic flow characteristics while ensuring conventional static flow characteristics. As a method for improving these dynamic flow characteristics, it is known to reduce a minimum injection amount through half lift control.

The half lift control controls a fuel injection valve with high accuracy in a state (hereinafter referred to as a half lift region) before a valve body provided in the fuel injection valve reaches a fully valve opening position (hereafter referred to as full lift). It is known that a variation in the injection amount in the half lift region becomes large due to the individual difference of the fuel injection valve. Therefore, various techniques for detecting the individual difference occurring in each fuel injection valve have been proposed.

PTL 1 below discloses a technique for indirectly detecting individual difference in a valve opening operation of a fuel injection valve (specifically, when a valve body is in a valve opening state) based on electrical characteristics. It is also a known technique to detect a closing operation of a fuel injection valve from electrical characteristics.

CITATION LIST

Patent Literature

PTL 1: JP 2014-152697 A

SUMMARY OF INVENTION

Technical Problem

In the half lift region, the fuel injection amount has a strong correlation with the actual valve opening time. Therefore, it is possible to know the variation in the injection amount by knowing the difference between the valve opening start timing and the valve closing completion timing (that is, the actual valve opening time) for each injection valve. Since the fuel injection valve having a preliminary stroke mechanism keeps a valve opening force constant in a region in which the injection amount is relatively large in the half lift region, the valve opening start timing is also constant. Therefore, the variation in the injection amount can be detected by detecting the valve closing completion timing. On the other hand, in the extremely small injection region, the valve opening force is not constant, and the valve opening start timing tends to be delayed as a pulse width is shortened. Therefore, in order to control the variation in the injection amount in the extremely small injection region, it is also necessary to detect the valve opening start timing.

However, in this region, since the amount of energization is small and the energization time is extremely short, it is difficult to detect the valve opening start timing based on the electrical characteristics.

The present invention has been made in view of the above-described problems, and an object of the present invention is to provide a technique for identifying a variation in an injection amount by estimating a valve opening start timing in an extremely small injection region of a half lift region.

Solution to Problem

A fuel injection control device according to the present invention estimates a valve opening start timing of a fuel injection valve by referring to a characteristic of a reference fuel injection valve acquired in advance.

Advantageous Effects of Invention

According to the present invention, a fuel injection control device can acquire a valve opening start timing of a fuel injection valve even in an extremely small injection region. Therefore, it is possible to reduce the variation in the injection amount of the fuel injection valve, and it is possible to prevent unintended torque variation or deterioration of fuel consumption and exhaust performance by expanding a control range in which the extremely small injection is performed.

DESCRIPTION OF EMBODIMENTS

Figure 1:
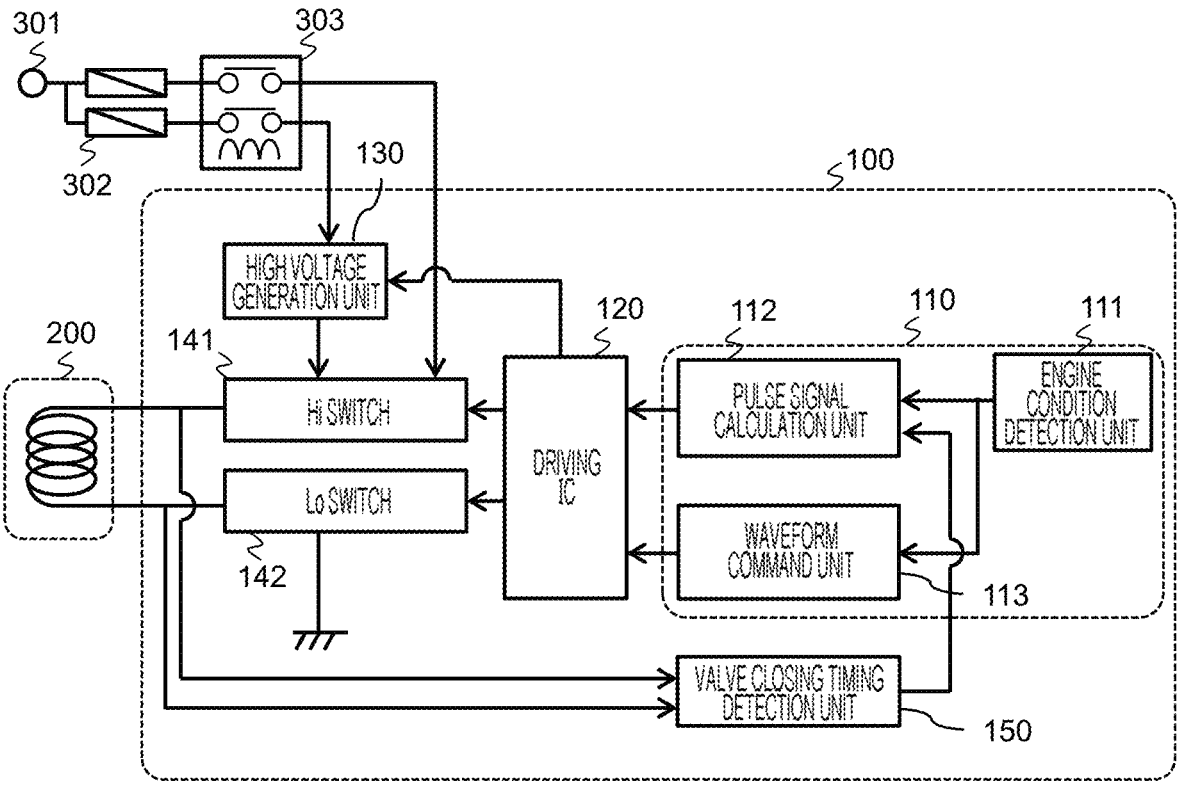
FIG. 1 is a diagram explaining a configuration of a conventional fuel injection control device 100 and a fuel injection valve 200.

FIG. 1 is a diagram explaining a configuration of a conventional fuel injection control device 100 and a fuel injection valve 200. The fuel injection control device 100 includes a microcomputer 110, a driving integrated circuit (IC) 120, a high voltage generation unit 130, a Hi switch 141, a Lo switch 142, and a valve closing timing detection unit 150. The microcomputer 110 further includes an engine condition detection unit 111, a pulse signal calculation unit 112, and a waveform command unit 113.

The engine condition detection unit 111 acquires various pieces of information such as an engine speed, an intake air amount, a cooling water temperature, a fuel pressure, and an engine failure state. The pulse signal calculation unit 112 calculates an injection pulse (width) which defines the fuel injection period of the fuel injection valve 200 based on the various pieces of information acquired from the engine condition detection unit 111.

The waveform command unit 113 calculates a command value of a driving current for opening the fuel injection valve 200 or maintaining the valve opening state, and outputs the command value to the driving IC 120.

The high voltage generation unit 130 uses a battery voltage 301 supplied through a fuse 302 and a relay 303 to generate a high power supply voltage (hereinafter referred to as a high voltage) required when the electromagnetic solenoid type fuel injection valve 200 is opened. In addition, the high voltage generation unit 130 boosts the battery voltage 301 to reach a desired target high voltage, based on a command from the driving IC 120.

Therefore, as a power source for the fuel injection valve 200, power supplies of two systems, that is the high voltage for securing a valve opening force of a valve body and the battery voltage 301 for holding the valve opening such that the valve body is not closed after the valve is opened can be supplied.

The two switches 141 and 142 are provided on the upstream side and the downstream side of the fuel injection valve 200. When these switches are turned on, the driving current is supplied to the fuel injection valve 200. The driving IC 120 controls the high voltage or the battery voltage 301 applied to the fuel injection valve 200 by switching the switches based on the injection pulse (width) calculated by the pulse signal calculation unit 112 and the driving current profile calculated by the waveform command unit 113. Therefore, the driving current supplied to the fuel injection valve 200 is controlled.

When the valve closing timing detection unit 150 controls the fuel injection valve 200 in the half lift region, the valve closing timing detection unit 150 detects the valve closing timing from the characteristic change of the driving voltage applied to the injection valve as a means for detecting the individual difference in injection valve behavior for each injection valve. The detection result is transmitted to the pulse signal calculation unit 112.

Figure 2:
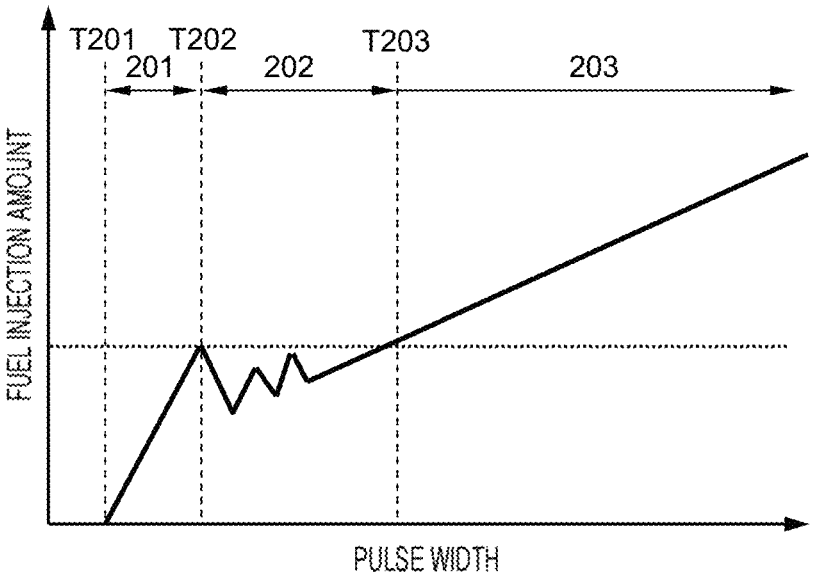
FIG. 2 is a graph explaining a difference between an injection amount characteristic in a full lift region and an injection amount characteristic in a half lift region.

FIG. 2 is a graph explaining the difference between the injection amount characteristic in the full lift region and the injection amount characteristic in the half lift region. A section 203 is a region in which the injection valve is fully opened and the fuel injection amount is proportional to the pulse width, and is referred to as the full lift region. A section 201 and a section 202 are regions in which the injection valve is not fully opened.

In the section 202, the valve body vibrates at the valve opening end in the injection valve due to an excess valve opening force, and the injection amount and the pulse width are not simply proportional to each other. Therefore, for example, the region in which the pulse width and the injection amount are proportional to each other can be expanded by adjusting the valve opening force with the driving current waveform different from that of the section 203 and reducing the vibration at the valve opening end.

The section 201 is a region in which the valve behavior and the injection amount have a strong correlation. In this region, since the mechanical characteristic or the electrical characteristic of the injection valve strongly affect the valve behavior, the pulse width and the injection amount are not simply proportional to each other, and the variation in the injection amount is simply aligned due to the variation in each injection valve.

Therefore, in the conventional art, the valve opening force is adjusted by switching the driving current, and the pulse width is controlled for each injection valve based on the detection result of the valve behavior, thereby reducing the individual difference in the injection amount. In the conventional art, attempts have been made such that the region in which the pulse width and the injection amount are proportional to each other expands to the section 201. However, it is difficult to control the variation in the injection amount for each injection valve even in the conventional art, especially in the extremely small injection amount region of the section 201. The present invention follows the conventional art, and further aims to accurately control the variation in the injection amount for each injection valve even in this extremely small injection region.

Figure 3:
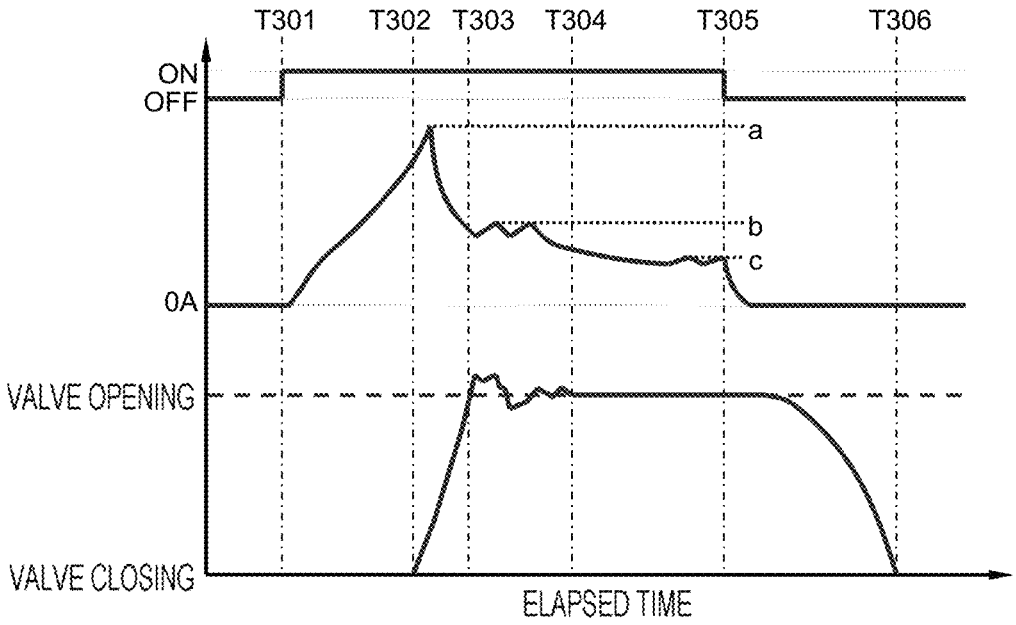
FIG. 3 is a graph explaining a relationship between an injection pulse width, a driving current waveform, and a valve behavior in a full lift region.

FIG. 3 is a graph explaining a relationship between the injection pulse width, the driving current waveform, and the valve behavior in the full lift region. The injection pulse rises from T301, and the driving current is started to energize the fuel injection valve 200 according to a preset current waveform profile. After the start of energization, the driving current reaches a peak a due to the high voltage for valve opening. After that, the driving voltage switches to the battery voltage and maintains a driving current b or c for a predetermined time. When it reaches T305, the injection pulse falls and the driving current stops energizing.

The injection valve starts opening at T302, and at T303, the valve body reaches the valve opening end and becomes the full lift. During a period from T303 to T304, the valve body vibrates and behaves unstable due to the excessive valve opening force. After the injection pulse is cut off at T305 and the energization is stopped, the valve opening force is lost, the valve body moves to the valve closing position, and the valve is closed at T306. In the full lift region, the valve body is fully opened, and therefore the relationship between the pulse width and the injection amount is simply proportional.

Figure 4:
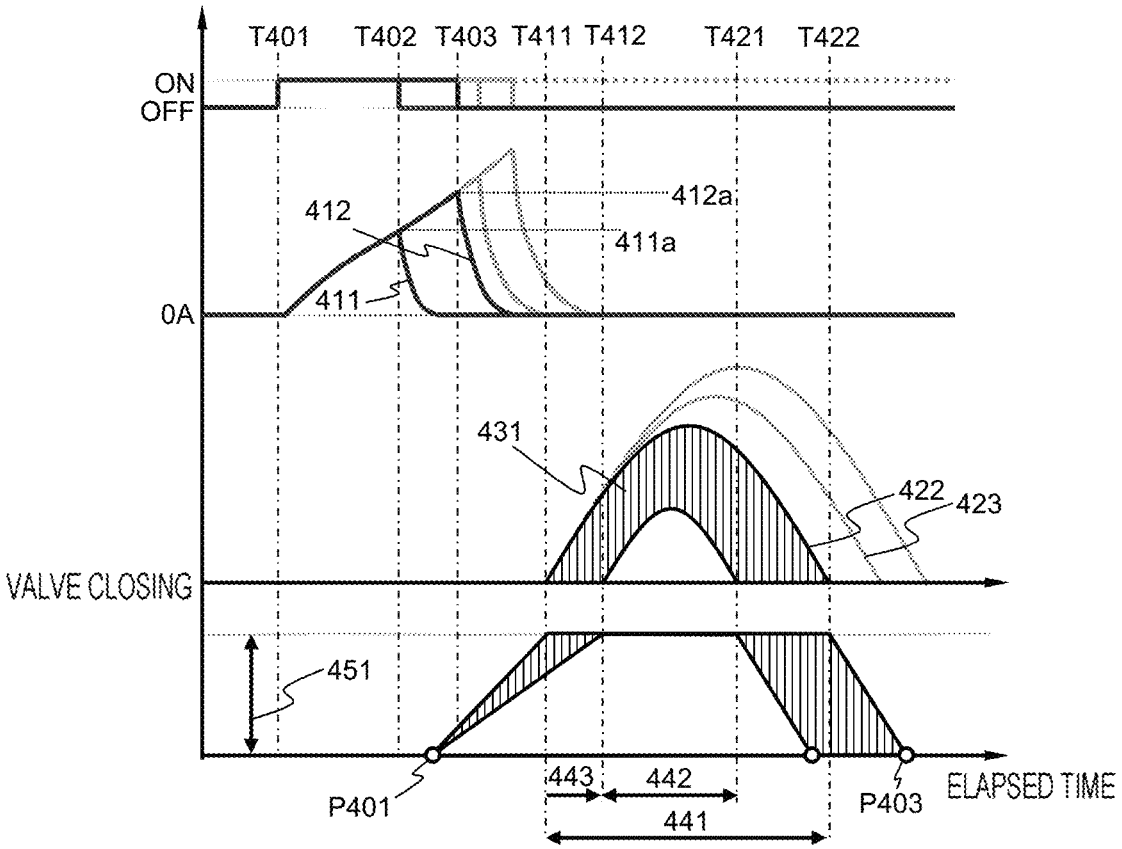
FIG. 4 is a graph explaining a relationship between an injection pulse width, a driving current waveform, and a valve behavior in a half lift region.

FIG. 4 is a graph explaining a relationship between the injection pulse width, the driving current waveform, and the valve behavior in the half lift region. The injection pulse width rises at T401 and falls at T403. A driving current 412 and a valve behavior during this period will be described.

The driving current starts energizing according to a preset current waveform profile. A high-voltage current is energized to a coil of the fuel injection valve 200, and the energization is cut off when the energization time (time from T401 to T403) elapses or when the driving current reaches 412*a*.

After the energization is cut off, the current quickly becomes 0 A. While energized, a magnetic force is generated by the coil, and a mover and a valve body provided in the fuel injection valve 200 receive, as the valve opening force, the difference between the magnetic force applied to the mover and the valve body and the force in the valve closing direction.

When the mover starts moving from P401 at which the valve opening force becomes a positive value in the valve opening direction, moves by a preliminary stroke 451 which is a length at which the mover can operate, and then comes into contact with the valve body at T411. The valve body starts opening at T411 due to the impact force due to the contact with the mover. Therefore, T411 will be referred to as the valve opening start timing.

Since the energization is completed at T411, it is not affected by the magnetic force, but is affected by spring load and fuel pressure in the valve closing direction. Since the spring load and the fuel pressure in the valve closing direction can be regarded as constant in a short period, the valve body makes a constant acceleration parabolic motion. A relationship between the time and the position of the valve body in the fuel injection valve 200 is represented by a parabola 422. The valve body completes the valve closing at T422 and the injection stops.

The mover continues to operate to a mover reference position and moves to P403.

Since the fuel injection amount is the amount of fuel injected while the valve body is in a parabolic motion, it can be seen that there is a strong correlation between the injection amount and the valve behavior. Since the amount of the valve behavior correlates with an area 431 surrounded by the parabola 422, it can be said that the injection amount also has a strong correlation with the area 431. Therefore, if the area 431 can be known, the injection amount can be known, but it is not practical to measure the valve behavior during the injection valve operation. When focusing on the fact that the valve behavior is a constant acceleration parabolic motion, it is mathematically obvious that the area 431 correlates with the time from the valve opening start timing T411 to the valve opening completion timing T422, that is, the valve opening time length 441. Therefore, if the valve opening time length 441 is detected, the injection amount can be obtained.

In the region in which the injection amount is controlled by the pulse width (that is, the region which is controlled by the injection pulse width longer than that from T401 to T403.), the valve behavior becomes a parabola 423. In addition, since the valve opening force is sufficient in this region and the impact force when the mover comes into contact with the valve body is constant, the valve opening start timing T411 is at the same position. Therefore, in the conventional art, the valve opening time length is obtained by detecting the valve closing time, and the injection amount control is performed based on the valve opening time length.

On the other hand, what the present invention controls is a region which is controlled with the pulse width shorter than that from T401 to T403. In this region, a driving current waveform is 411, and a maximum current 411*a* is smaller than that of 412*a*. Therefore, the magnetic force is reduced and the valve opening force is weakened, which affects the responsiveness of the mover. That is, the time when the mover comes into contact with the valve body is delayed by a time length 443. Since the assumption that the valve opening start timing is constant as in the conventional art is not established, it is necessary to know a valve opening start timing T412 in order to detect a valve opening time length 442. Although a technique for detecting the valve opening completion timing from the change in the current value is known, it is difficult to apply the technique because the valve opening starts after the energization is completed in the region targeted by the present invention.

Figure 5:
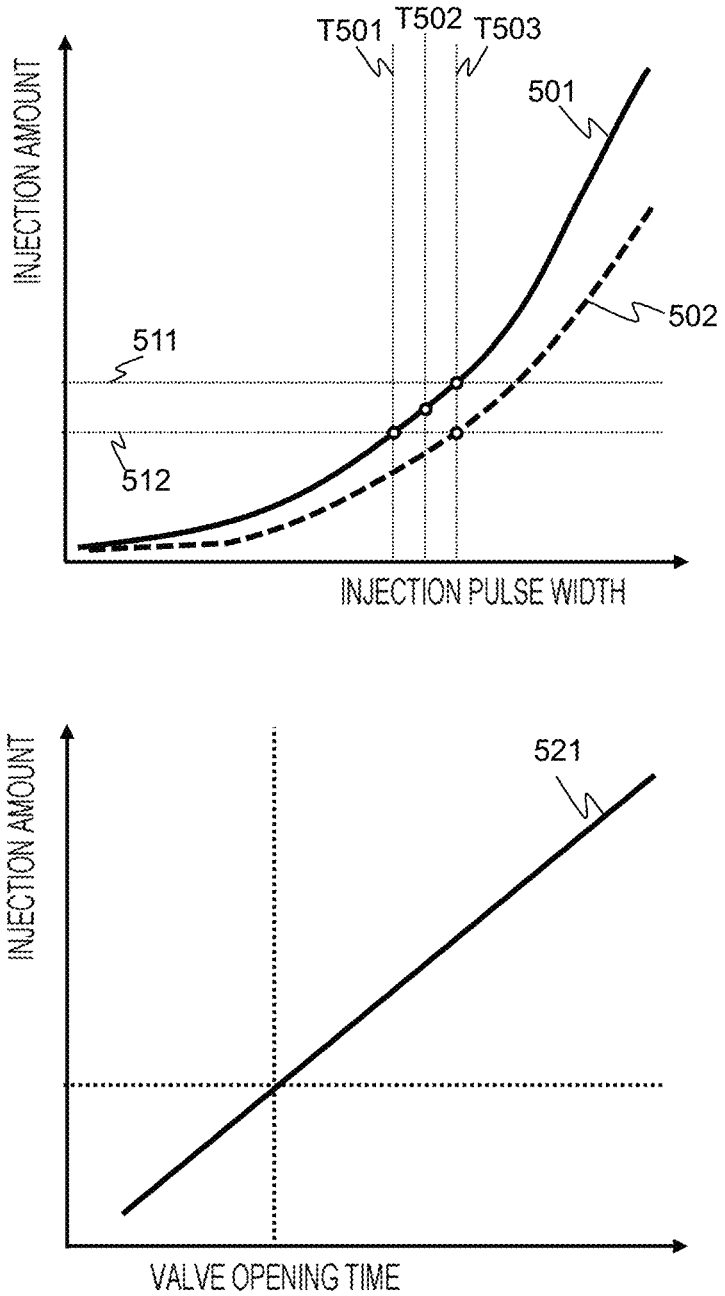
FIG. 5 is a diagram explaining that a variation in an injection amount is suppressed by a valve opening time length.

FIG. 5 is a diagram explaining that the variation in the injection amount is suppressed by the valve opening time length. The upper drawing of FIG. 5 shows a relationship between the injection amount and the injection pulse width. The lower drawing of FIG. 5 shows a relationship between the injection amount and the valve opening time.

The upper drawing of FIG. 5 shows a relationship in a certain injection valve 501 and a relationship in another injection valve 502. A range of the injection amount is a range of the extremely low amount targeted by the present invention, and corresponds to the vicinity of T201 in the section 201 of FIG. 2. Since there is the variation in individual difference, when controlled with the same injection pulse width T503, the injection amounts are respectively 511 and 512 and do not match each other. A case in which the injection amount is aligned to 512 will be described below.

The pulse width of the injection valve 501 needs to be corrected to T501. Therefore, according to the conventional art, the valve closing timing of each injection valve can be detected and the pulse width of the injection valve 501 can be corrected to, for example, T502. This correction in the conventional art assumes that the valve opening start timing is constant. However, as described above with reference to FIG. 4, since the valve opening start timing is not constant in the extremely small injection region, it is necessary to correct the pulse width further shorter in practice. Therefore, the injection amount is uneven with the conventional art alone.

In the lower drawing of FIG. 5, a line 521 shows a relationship between an injection amount and a result of measuring a valve behavior for each injection valve by an experiment and detecting an actual valve opening time. Although not completely matched in practice, it is confirmed that a measurement result for each of a plurality of injection valves is on the line 521. That is, it is known that the variation in the injection amount can be accurately controlled even at the extremely low injection amount by accurately detecting the valve opening time.

Figure 6:
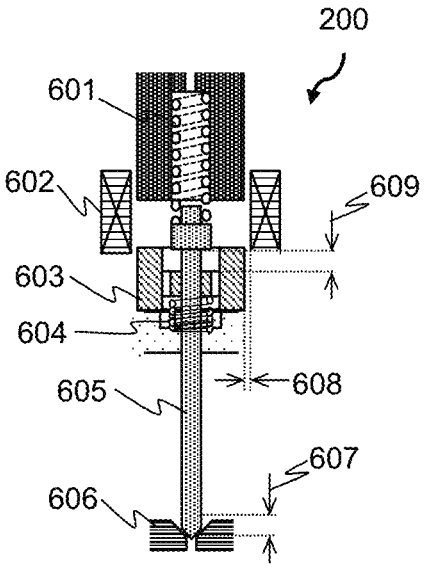
FIG. 6 is a diagram explaining components of a fuel injection valve 200.

FIG. 6 is a diagram explaining components of the fuel injection valve 200. The fuel injection valve 200 includes a valve closing spring 601, a coil 602, a mover 603, a mover position defining spring 604, a valve body 605, and a valve seat 606. The valve body 605 operates in a section 607. In a portion in which the mover 603 slides, a gap 608 is designed between the mover 603 and the coil or an exterior. The mover 603 operates in a preliminary stroke 609.

As described above with reference to FIG. 4, the valve opening start timing is the timing at which the mover 603 comes into contact with the valve body 605 after the injection pulse has risen. Therefore, characteristics related to the movement of the mover 603 affect the valve opening start timing. The characteristics related to the movement of the mover 603 can be classified into mechanical characteristic values and electrical characteristic values.

The mechanical characteristic relates to the difficulty of the movement of the mover 603. For example, there are the mass of the mover 603, the spring load by the mover position defining spring 604, the design value of the gap 608, and the preliminary stroke 609 related to the operating time of the mover 603. Various other factors can be considered, but the above factors have a particularly great influence.

The electrical characteristic includes a driving voltage (effective voltage value or target value) which affects the strength of the driving current that generates the valve opening force, a coil resistance which makes it difficult to energize the driving current, a coil inductance, and the like. Various other factors can be considered, but the above factors have a particularly great influence.

Figure 7:
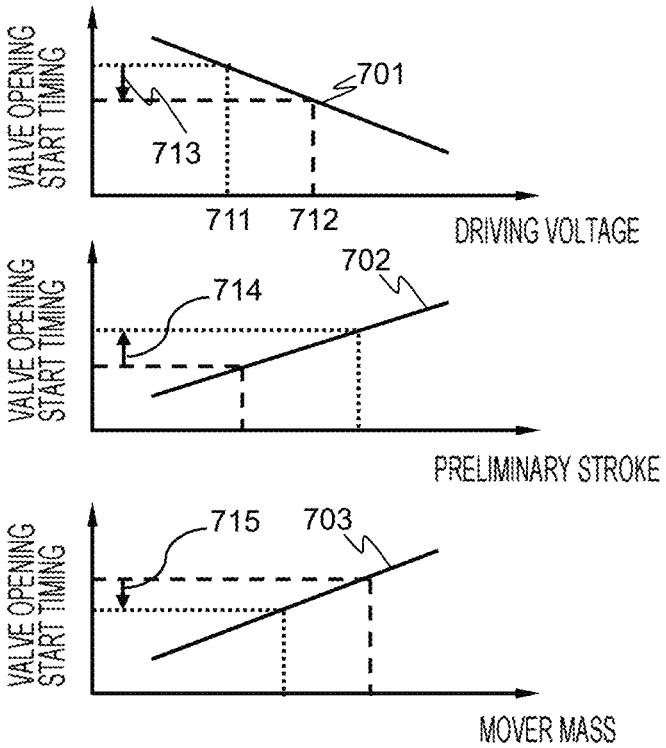
FIG. 7 is a diagram explaining a relationship between a valve opening start timing and a mechanical characteristic or an electrical characteristic that correlates with the valve opening start timing.

FIG. 7 is a diagram explaining a relationship between the valve opening start timing and the mechanical characteristic or the electrical characteristic that correlates with the valve opening start timing. Here, three typical parameters among the characteristic values presented in FIG. 6 are shown as an example.

The upper drawing of FIG. 7 shows a relationship 701 between the valve opening start timing and the driving voltage of the fuel injection valve 200. The driving voltage affects how the driving current rises. That is, there is an effect of accelerating the movement of the mover by affecting how the valve opening force rises.

Therefore, since the movement of the mover is accelerated in proportion to the rise in the driving voltage, the valve opening start timing is shortened.

The middle drawing of FIG. 7 shows a relationship 702 between the valve opening start timing and the preliminary stroke amount. Since the preliminary stroke amount corresponds to the movement amount of the mover, the preliminary stroke amount is related to the movement time of the mover. Therefore, since the movement time of the mover becomes longer in proportion to the increase in the preliminary stroke, the valve opening start timing becomes longer.

The lower drawing of FIG. 7 shows a relationship 703 between the valve opening start timing and the mover mass. Since the mover mass affects the difficulty of the movement of the mover, the mover mass is related to the movement time of the mover. Therefore, since the movement time of the mover becomes longer in proportion to the increase in the mover mass, the valve opening start timing becomes longer.

Assuming that the relationship between each parameter illustrated in FIG. 7 and the valve opening start timing can be considered to be the same for each individual fuel injection valve 200, the valve opening start timing of the fuel injection valve 200 can be obtained by acquiring the relationship shown in FIG. 7 in advance for the reference fuel injection valve and applying each parameter in the fuel injection valve 200 (that is, each value on the horizontal axis of FIG. 7) to each corresponding relationship. According to this principle, the present invention estimates the valve opening start timing in the extremely small injection region.

For example, in the upper drawing of FIG. 7, when the characteristic value of the reference injection valve is 711 and the characteristic value of the fuel injection valve 200 is 712, the deviation of the valve opening start timing due to the variation in the driving voltage is 713. Similarly, for other characteristic values, the amount of the valve opening start timing can be calculated. The deviation of the valve opening start timing of the target fuel injection valve can be calculated as the total value of 713, 714, and 715 in FIG. 7.

Figure 8:
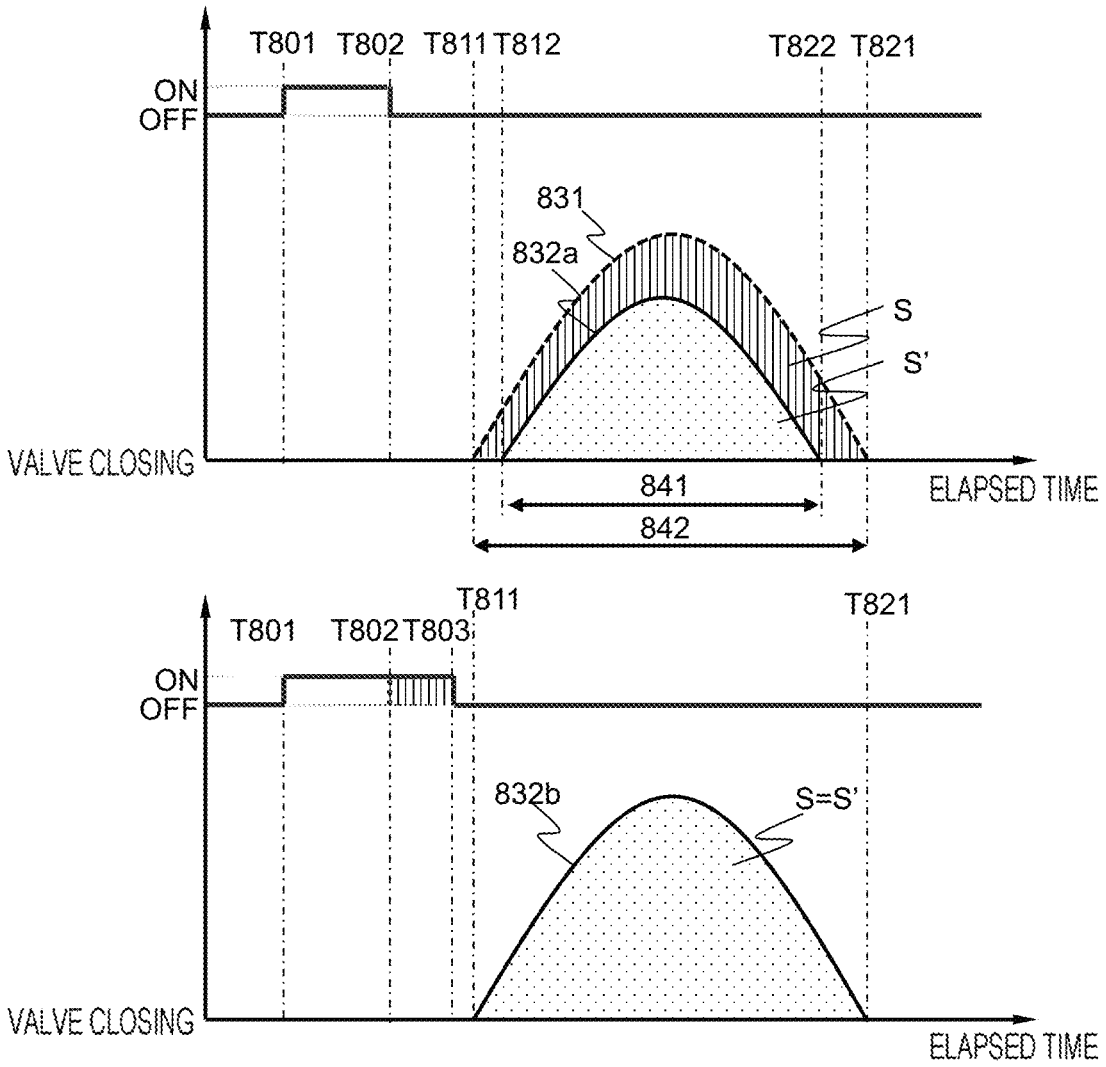
FIG. 8 is a graph explaining a change in valve behavior when an injection amount is controlled based on an actual valve opening time.

FIG. 8 is a graph explaining a change in valve behavior when an injection amount is controlled based on an actual valve opening time. The upper drawing of FIG. 8 shows a target injection valve behavior 831 and an actual injection valve behavior 832*a* when an injection pulse starts in a section from T801 to T802 and is controlled. As for the valve opening start timing, the target valve behavior is T811, while the actual injection valve behavior is T812. The valve opening start timing T812 is calculated by the method described above with reference to FIG. 7, and the valve closing completion timing T822 is detected by the conventional art. An actual valve opening time length 841 is calculated from the valve closing completion timing T822 and the valve opening start timing T812. The target valve opening time length 842 of the target valve behavior is calculated from a required injection amount and the like.

As shown in the upper drawing of FIG. 8, when the actual valve opening time length 841 is smaller than the target valve opening time length 842, the valve opening time length can be expanded by increasing the valve opening force. Therefore, a relationship between the valve opening time length and the pulse width is prepared in advance, and the pulse width is corrected based on this relationship. In the case of FIG. 8, the pulse width is extended from T802 to T803, so that the valve opening time length is aligned to 842 and a valve behavior 832*b* of the target injection valve matches the target injection valve behavior 831 (lower drawing of FIG. 8). Therefore, the variation in the injection amount for each injection valve can be aligned with the injection amount of the reference injection valve.

Figure 9:
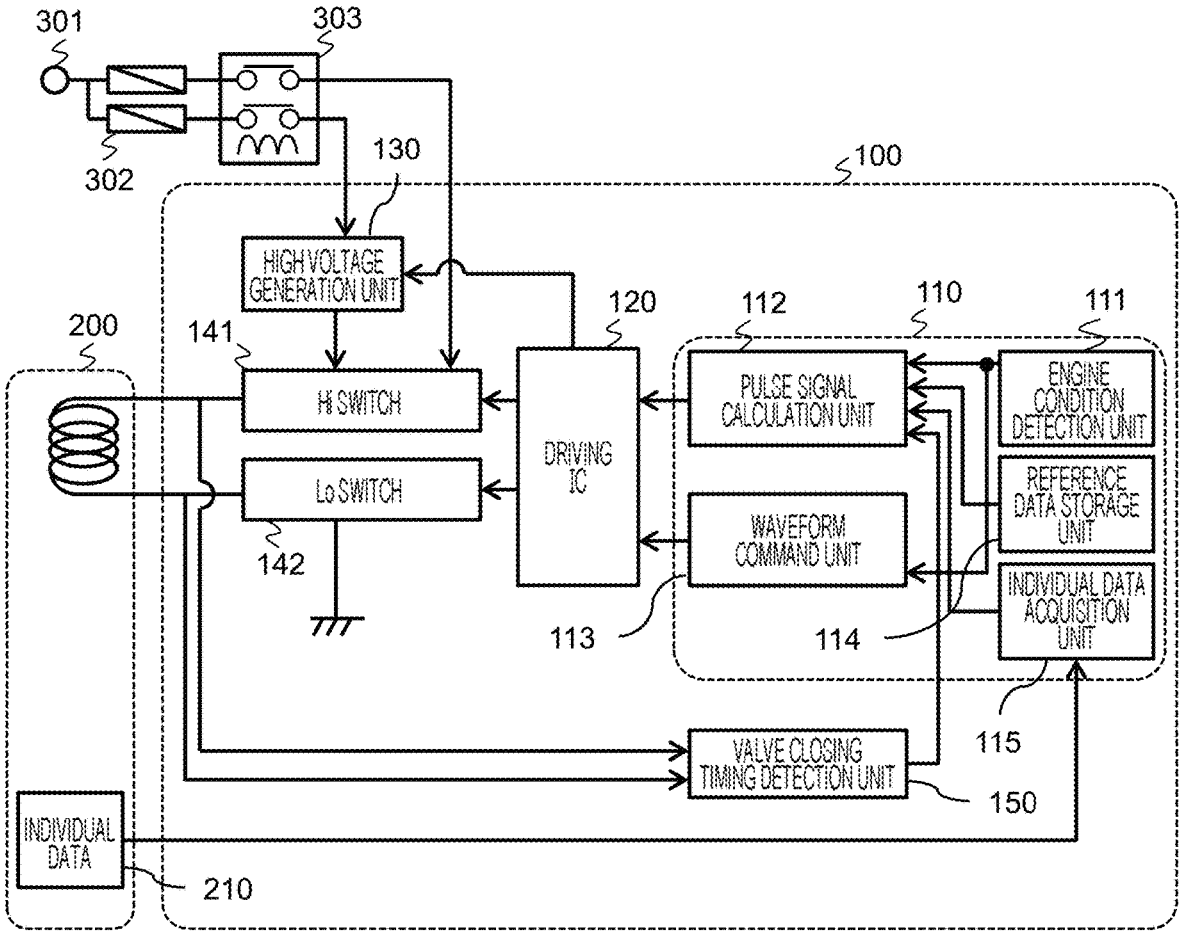
FIG. 9 is a configuration diagram of a fuel injection control device 100 according to a first embodiment.

FIG. 9 is a configuration diagram of a fuel injection control device 100 according to a first embodiment of the present invention. In addition to the configuration described above with reference to FIG. 1, the microcomputer 110 includes a reference data storage unit 114 and an individual data acquisition unit 115, and the fuel injection valve 200 holds individual data 210. Since the other configurations are the same as those in FIG. 1, the differences related to these functional parts will be mainly described below.

The reference data storage unit 114 stores reference data. The reference data describes the relationship between the valve opening start timing of the reference fuel injection valve and the pulse width or the injection amount, and also describes the relationship between each parameter illustrated in FIG. 7 and the valve opening start timing for the reference fuel injection valve. The individual data acquisition unit 115 reads the individual data 210 included in the fuel injection valve 200. The individual data 210 describes the characteristic value of the fuel injection valve 200 (corresponding to the characteristic value 712 in FIG. 7) for each characteristic parameter. As the timing for reading the individual data 210, for example, the time when the fuel injection valve 200 is shipped can be considered.

Figure 10:
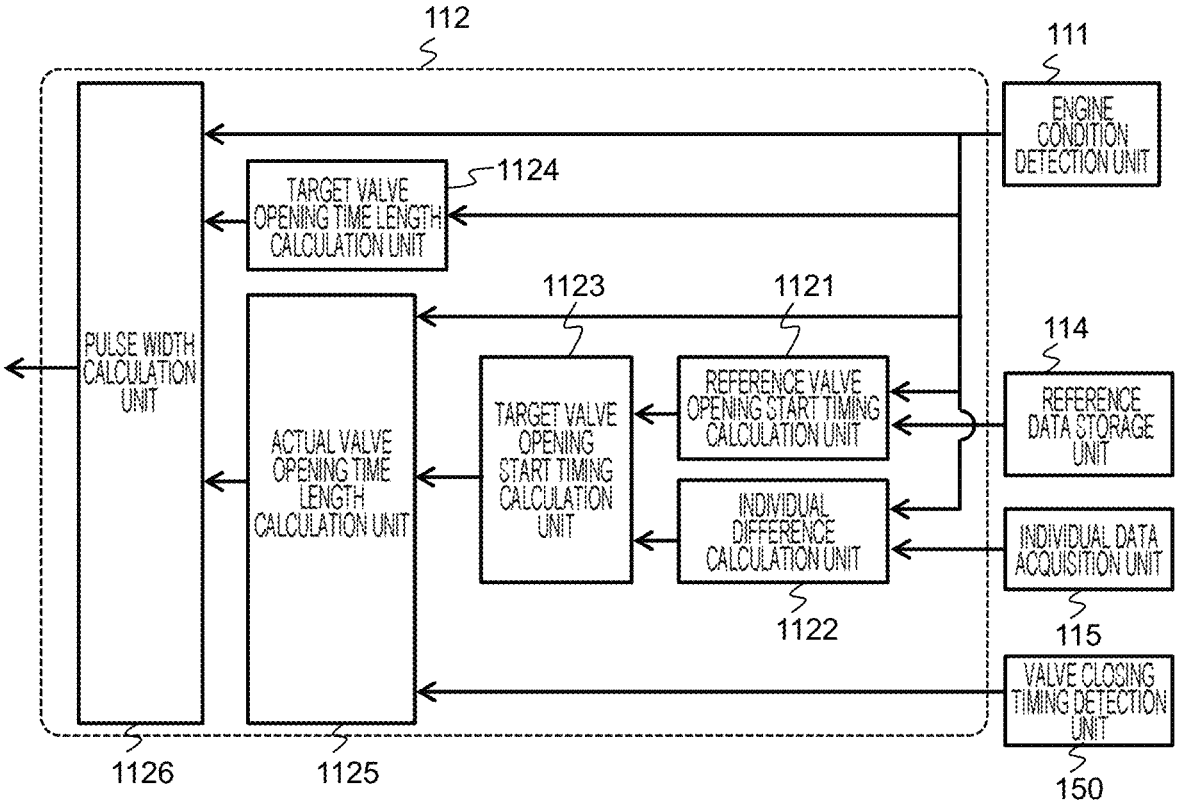
FIG. 10 is a configuration diagram of a pulse signal calculation unit 112 according to the first embodiment.

FIG. 10 is a configuration diagram of the pulse signal calculation unit 112 according to the first embodiment. Hereinafter, the differences between the pulse width calculation in the conventional art and the pulse width calculation in the first embodiment will be described with reference to FIG. 10.

In the conventional art, the fuel injection amount is controlled in a region in which the valve opening start timing can be regarded as constant. Therefore, an actual valve opening time length calculation unit 1125 calculates an actual valve opening time length from a difference between a predetermined valve opening start timing and a valve closing timing detected by a valve closing timing detection unit 150. The pulse width calculation unit 1126 calculates a pulse width correction amount by comparing a calculation result of a target valve opening time length calculation unit 1124 with the actual valve opening time length. Furthermore, an injection pulse width is corrected by the pulse width correction amount, based on a engine condition acquired from an engine condition detection unit 111, and the corrected injection pulse width is output as the injection pulse width.

On the other hand, in the first embodiment, the valve opening start timing of the reference fuel injection valve is obtained according to the description of the reference data, and the individual difference between the valve opening start timing of the reference fuel injection valve and the valve opening start timing of the fuel injection valve 200 is obtained according to the description of the individual data 210. A target valve opening start timing calculation unit 1123 obtains the valve opening start timing of the fuel injection valve 200 based on these. Details of the respective functional units will be described with reference to FIGS. 11 and subsequent drawings.

Figure 11:
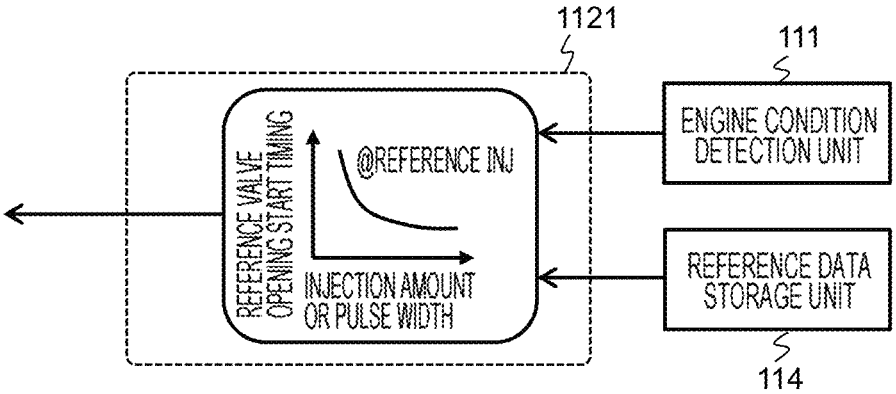
FIG. 11 is a diagram explaining details of a reference valve opening start timing calculation unit 1121.

FIG. 11 is a diagram explaining details of a reference valve opening start timing calculation unit 1121. The reference valve opening start timing calculation unit 1121 acquires reference data from the reference data storage unit 114, and further acquires a required injection pulse width or a required injection amount from the engine condition detection unit 111. The reference valve opening start timing calculation unit 1121 obtains the valve opening start timing of the reference fuel injection valve by referring to the reference data using the required injection amount or the required injection pulse width.

Figure 12:
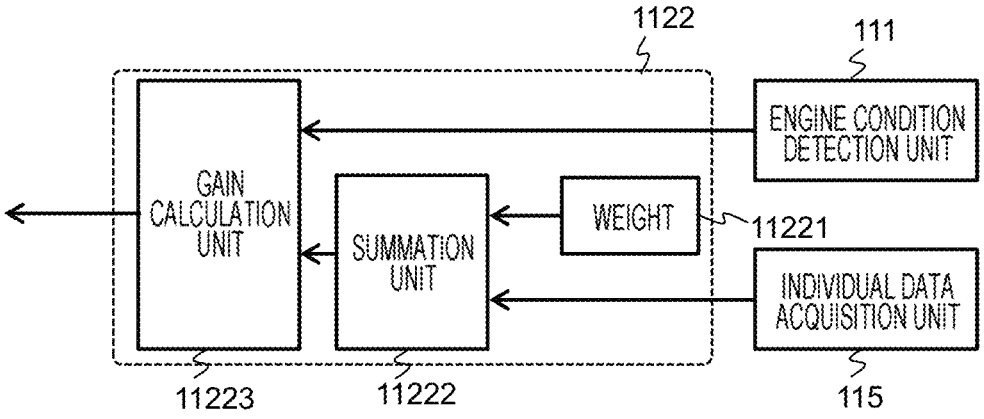
FIG. 12 is a diagram explaining details of an individual difference calculation unit 1122.

FIG. 12 is a diagram explaining details of an individual difference calculation unit 1122. A summation unit 11222 acquires the characteristic value of the fuel injection valve 200 from the individual data acquisition unit 115. The summation unit 11222 obtains the difference between the valve opening start timing of the fuel injection valve 200 and the valve opening start timing of the reference fuel injection valve for each characteristic parameter illustrated in FIG. 7, and multiplies and sums preset weights 11221 for each characteristic parameter. This corresponds to the weighted sum of 713 to 715 in FIG. 7. When characteristic parameters other than those illustrated in FIG. 7 are present, the weighted sum is performed on all of them in a similar manner. A gain calculation unit 11223 calculates the individual difference of the valve opening start timing corresponding to the required injection amount or the required pulse width by multiplying the summation result by a gain corresponding to the required injection amount or the required pulse width.

Figure 13:
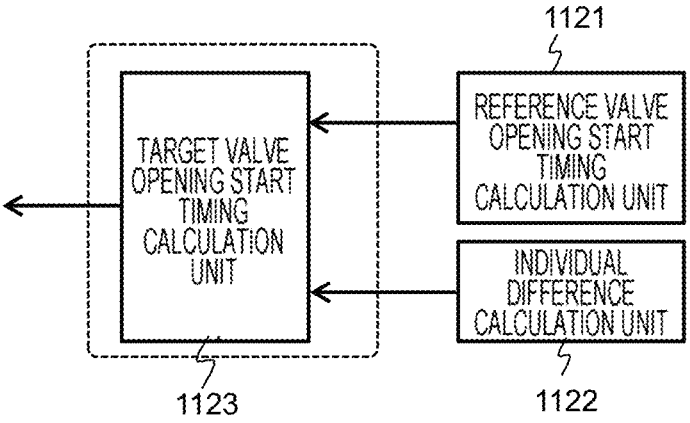
FIG. 13 is a diagram explaining details of a target valve opening start timing calculation unit 1123.

FIG. 13 is a diagram explaining details of the target valve opening start timing calculation unit 1123. The target valve opening start timing calculation unit 1123 calculates the valve opening start timing of the fuel injection valve 200 by summing the calculation result obtained by the reference valve opening start timing calculation unit 1121 and the calculation result obtained by the individual difference calculation unit 1122.

Figure 14:
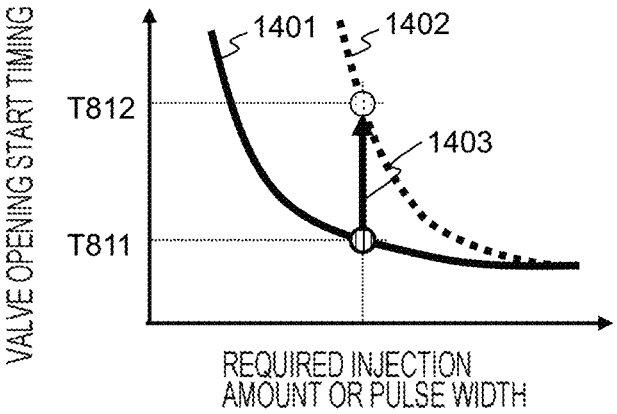
FIG. 14 is a diagram explaining the calculation performed by the target valve opening start timing calculation unit 1123.

FIG. 14 is a diagram explaining the calculation performed by the target valve opening start timing calculation unit 1123. A solid line 1401 is the relationship between the valve opening start timing of the reference fuel injection valve and the injection amount or the pulse width. A broken line 1402 is the relationship between the valve opening start timing of the fuel injection valve 200 and the injection amount or the pulse width. The target valve opening start timing calculation unit 1123 calculates the valve opening start timing T812 of the fuel injection valve 200 by calculating the reference valve opening start timing T811 and the individual difference 1403 and adding the individual difference 1403 to T811. Therefore, it is possible to estimate the valve opening start timing in the extremely small injection region, which has been difficult to detect in the past.

Figure 15:
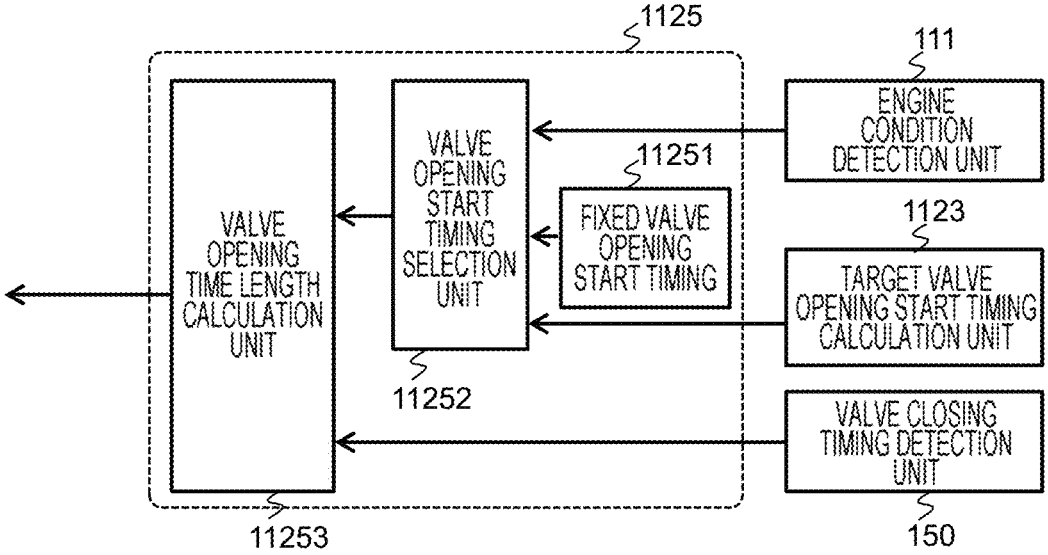
FIG. 15 is a diagram explaining details of an actual valve opening time length calculation unit 1125.

FIG. 15 is a diagram explaining details of the actual valve opening time length calculation unit 1125. A valve opening start timing selection unit 11252 selects one of a predetermined fixed valve opening start timing 11251 and the calculation result obtained by the target valve opening start timing calculation unit 1123 according to the required injection amount or the required pulse width. A valve opening time length calculation unit 11253 calculates an actual valve opening time length by subtracting the selection result obtained by the valve opening start timing selection unit 11252 from the detection result obtained by the valve closing timing detection unit 150.

Figure 16:
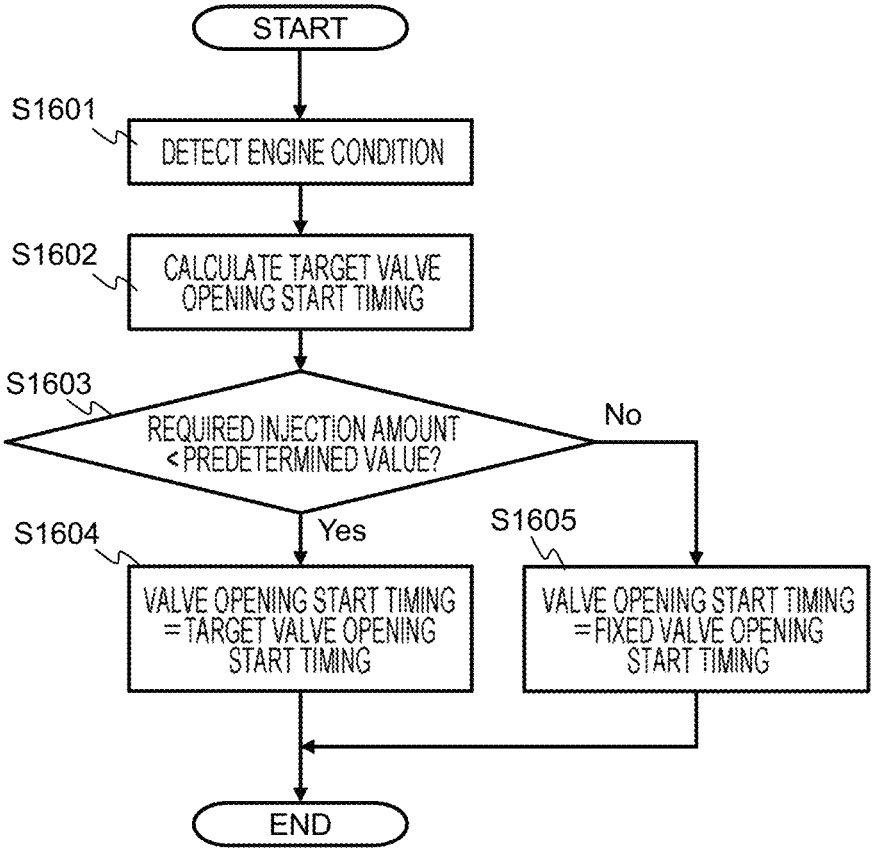
FIG. 16 is a flowchart explaining an operation procedure of the actual valve opening time length calculation unit 1125.

FIG. 16 is a flowchart explaining an operation procedure of the actual valve opening time length calculation unit 1125.

The valve opening start timing selection unit 11252 acquires the required injection pulse width or the required injection amount (S1601). The valve opening start timing selection unit 11252 acquires the valve opening start timing of the fuel injection valve 200 from the target valve opening start timing calculation unit 1123 (S1602). The valve opening start timing selection unit 11252 determines whether or not the required injection amount or the required pulse width acquired in S1601 is smaller than a predetermined value (S1603). When the required value is smaller, the value obtained from the target valve opening start timing calculation unit 1123 is adopted (S1604); otherwise, the fixed valve opening start timing 11251 is adopted (S1605).

The predetermined value in step S1603 may be either a required value corresponding to the boundary between the full lift region and the half lift region, or a minimum required value which is less than or equal to the required value and at which the valve opening force is sufficiently large and the valve opening start timing is constant. As shown in FIG. 16, by selecting which of the calculation result obtained by the target valve opening start timing calculation unit 1123 and the fixed valve opening start timing 11251 is adopted, it is not necessary to reconstruct all the control processing by the conventional technique in which the valve opening start timing is the fixed value. This is convenient for implementation.

Figure 17:
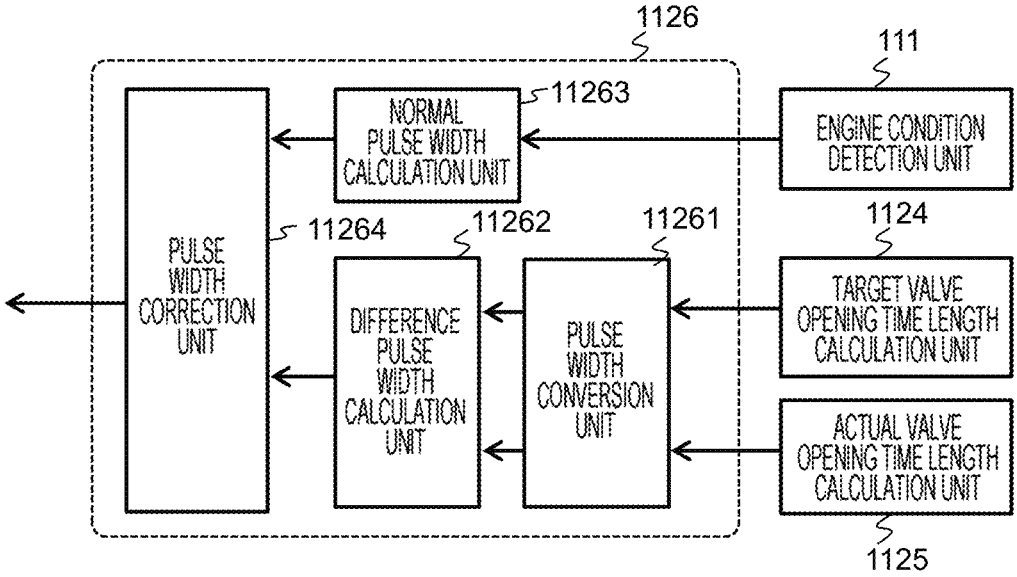
FIG. 17 is a diagram explaining details of a pulse width calculation unit 1126.

FIG. 17 is a diagram explaining details of the pulse width calculation unit 1126. The pulse width conversion unit 11261 converts, based on the relationship between the pulse width prepared in advance and the valve opening time length, the valve opening time length calculated by the target valve opening time length calculation unit 1124 and the valve opening time length calculated by the actual valve opening time length calculation unit 1125 into pulse widths, respectively. A difference pulse width calculation unit 11262 calculates the difference between the pulse width based on the target valve opening time length and the pulse width based on the actual valve opening time length. A normal pulse width calculation unit 11263 calculates a normal pulse width based on the detection result obtained by the engine condition detection unit 111. When the calculation result obtained by the normal pulse width calculation unit 11263 is less than or equal to a predetermined value, a pulse width correction unit 11264 corrects the pulse width by adding the calculation result obtained by the difference pulse width calculation unit 11262. When the pulse width based on the actual valve opening time length is longer than the pulse width based on the target valve opening time length, a negative difference pulse width is applied. In an opposite case, a positive difference pulse width is applied.

Figure 18:
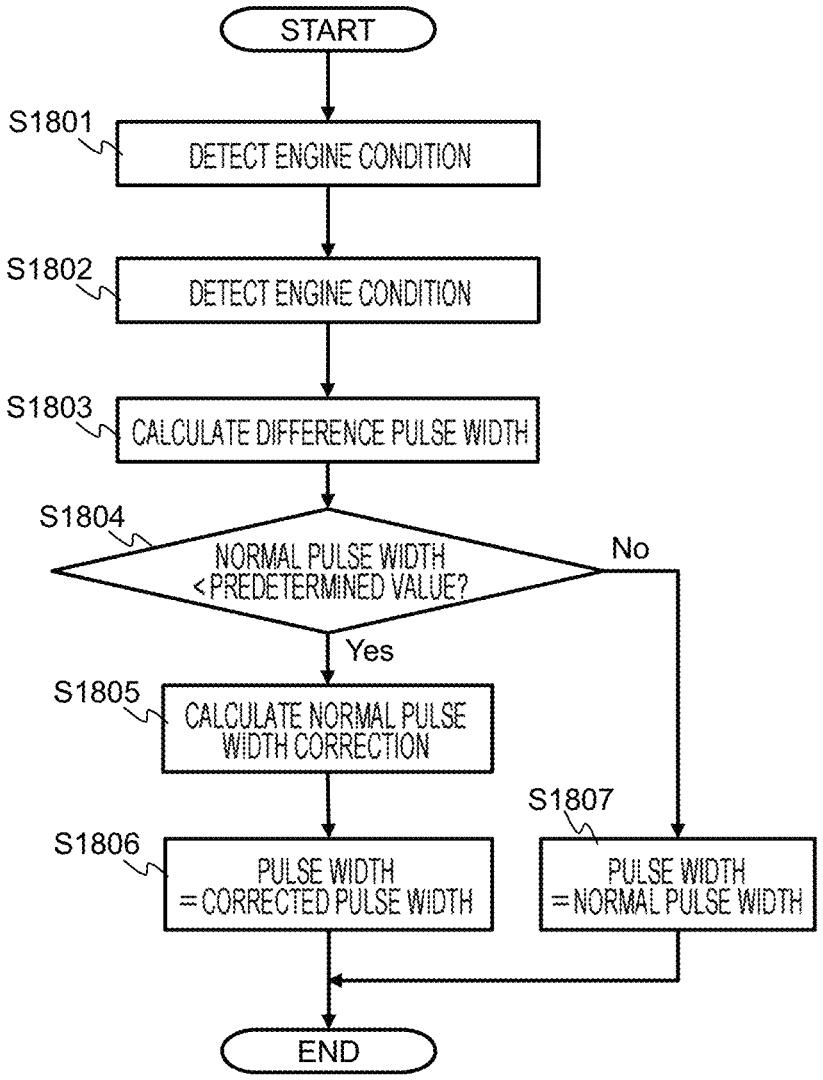
FIG. 18 is a flowchart explaining an operation procedure of the pulse width calculation unit 1126.

FIG. 18 is a flowchart explaining an operation procedure of the pulse width calculation unit 1126. The normal pulse width calculation unit 11263 acquires the required injection amount or the required injection pulse width and the fuel pressure from the engine condition detection unit 111 (S1801). The normal pulse width calculation unit 11263 calculates the normal pulse width by using the required injection amount or the required injection pulse width and the fuel pressure (S1802). The difference pulse width calculation unit 11262 calculates the difference pulse width (S1803). The pulse width correction unit 11264 determines whether or not the calculation result of the normal pulse width is less than a predetermined value (S1804). When less than the predetermined value, the normal pulse width is corrected from the normal pulse width and the difference pulse width (S1805), and the corrected pulse width is adopted (S1806). When less than or equal to the predetermined value, the normal pulse width is adopted (S1807).

Similar to the predetermined value in step S1603, the predetermined value in step S1804 may be either a required value corresponding to the boundary between the full lift region and the half lift region, or a minimum pulse width which is less than or equal to the required value and at which the valve opening force is sufficiently large and the valve opening start timing is constant.

First Embodiment: Summary

The fuel injection control device 100 according to the first embodiment is the fuel injection control device (100) which controls the fuel injection valve (200) of the internal combustion engine, and includes the valve opening start timing calculation unit (1123) which estimates the valve opening start timing at which the fuel injection valve (200) starts to open, and the reference data storage unit (114) which stores the reference data describing the characteristic of the reference fuel injection valve used as the reference when the valve opening start timing calculation unit (1123) estimates the valve opening start timing. The valve opening start timing calculation unit (1123) estimates the valve opening start timing by referring to the reference data using the characteristic parameters representing the characteristic of the fuel injection valve (200). Therefore, the valve opening start timing of the fuel injection valve 200 can be estimated from the characteristic of the reference fuel injection valve.

The reference data describes the relationship between the reference characteristic parameter representing the characteristic of the reference fuel injection valve and the reference valve opening start timing at which the reference fuel injection valve starts to open. The valve opening start timing calculation unit (1123) estimates the valve opening start timing by acquiring, from the reference data, the reference valve opening start timing corresponding to the characteristic parameter representing the characteristic of the fuel injection valve (200). Therefore, the valve opening start timing of the fuel injection valve 200 can be estimated by grasping the relationship between the characteristic of the reference fuel injection valve and the reference valve opening start timing in advance.

The fuel injection control device (100) further includes the reference valve opening start timing calculation unit (1121) which obtains the reference valve opening start timing using the reference data.

The fuel injection control device (100) further includes the individual difference calculation unit (1122) which obtains the difference between the reference valve opening start timing and the valve opening start timing using the characteristic of the fuel injection valve (200). The valve opening start timing calculation unit (1123) estimates the timing, at which the fuel injection valve (200) starts to open, according to the difference obtained by the individual difference calculation unit (1122). Therefore, even when it is difficult to detect the valve opening start timing itself of the fuel injection valve (200), the valve opening start timing can be estimated from the difference from the reference valve opening start timing.

The reference data describes the relationship between the reference characteristic parameter and the reference valve opening start timing for each of the plurality of reference characteristic parameters. The valve opening start timing calculation unit (1123) identifies the reference characteristic parameter corresponding to the characteristic parameter and acquires, from the reference data, the difference between the valve opening start timing and the reference valve opening start timing corresponding to the identified reference characteristic parameter. The valve opening start timing calculation unit (1123) estimates the valve opening start timing by multiplying the difference by the weight determined for each reference characteristic parameter and adding the multiplying result to the reference valve opening start timing. Therefore, even when the influence on the valve opening start timing differs according to the characteristic of the fuel injection valve (200), the valve opening start timing can be estimated in consideration of the influence.

The fuel injection control device (100) further includes the valve opening time length calculation unit (112) which defines the valve opening time length for opening the fuel injection valve (200). The valve opening time length calculation unit (112) defines the valve opening time length so as to open the fuel injection valve (200) from the valve opening start timing estimated by the valve opening start timing calculation unit (1123) until the target valve opening time length of the fuel injection valve (200) is reached. Therefore, the injection amount by the fuel injection valve (200) can be adjusted to the target value according to the estimated valve opening start timing.

The fuel injection control device (100) further includes the switching elements (141, 142) which turn on/off the driving current supplied to the fuel injection valve (200). The fuel injection control device (100) further includes the pulse width calculation unit (1126) which calculates the pulse width of the signal for turning on the switching elements (141, 142). The pulse width calculation unit (1126) calculates the pulse width so as to open the fuel injection valve (200) from the valve opening start timing estimated by the valve opening start timing calculation unit (1123) until the target valve opening time length of the fuel injection valve (200) is reached. Therefore, the injection amount by the fuel injection valve (200) can be adjusted to the target value using the pulse width control according to the estimated valve opening start timing.

The fuel injection control device (100) further includes the valve closing timing detection unit (150) which detects the valve closing timing when the fuel injection valve (200) is closed. The fuel injection control device (100) further includes the actual valve opening time length calculation unit (1125) which calculates the actual valve opening time length, at which the fuel injection valve (200) is actually opened, according to the valve opening start timing and the valve closing timing. The valve opening time length calculation unit (112) adjusts the valve opening time length so that the actual valve opening time length matches the target valve opening time length. Therefore, the valve opening time length can be adjusted according to the estimated valve opening start timing and the actual valve closing timing. That is, the injection amount of the fuel injection valve 200 can be controlled by utilizing the technique for detecting the valve closing timing in the conventional art.

The reference data describes the mechanical characteristic of the reference fuel injection valve. The mechanical characteristic of the reference fuel injection valve is at least one of the stroke amount (609) in which the mover (603) included in the reference fuel injection valve moves from the time when the mover (603) starts to move to the time when the reference fuel injection valve comes into contact with the valve body (605), the mass of the mover (603), the gap (608) provided between the mover (603) and the reference fuel injection valve in the portion in which the mover (603) slides, and the spring load of the spring (604) which moves the mover (603) in the direction of closing the reference fuel injection valve. Therefore, the valve opening start timing can be estimated according to the movement characteristic of the mover (603). Since the movement characteristic of the mover (603) can be known at the time of design or manufacture, it is useful to use this for estimation.

The reference data describes the electrical characteristic of the reference fuel injection valve. The electrical characteristic of the reference fuel injection valve is at least one of the electrical resistance of the coil (602) which electromagnetically drives the valve body of the reference fuel injection valve, the inductance of the coil (602), and the effective value or the target value of the driving voltage supplied to the reference fuel injection valve. Therefore, the valve opening start timing can be estimated according to the electrical characteristic of the fuel injection valve (200). Since the electrical characteristic of the fuel injection valve (200) can be obtained relatively easily, it is useful to use this for estimation.

The fuel injection control device (100) further includes the driving circuit (120) which opens the fuel injection valve (200) by supplying the driving current thereto. The driving circuit (120) lowers the driving current when the fuel injection amount by the fuel injection valve (200) reaches the target value. Therefore, the injection amount by the fuel injection valve (200) can be appropriately controlled on the assumption of the estimated valve opening start timing.

The fuel injection control device (100) further includes the actual valve opening time length calculation unit (1125) which obtains the actual opening time length when the fuel injection valve (200) is opened. The actual valve opening time length calculation unit (1125) switches whether or not to obtain the actual valve opening time length using the valve opening start timing estimated by the valve opening start timing calculation unit (1123) according to at least one of the first required value for the injection amount of fuel injected by the fuel injection valve (200) or the second required value for the pulse width of the driving signal for controlling the switching elements (141, 142) supplying the driving current to the fuel injection valve (200). When the first required value or the second required value is greater than or equal to a predetermined threshold value, the actual valve opening time length calculation unit (1125) uses a predefined timing as the valve opening start timing of the fuel injection valve (200) instead of the valve opening start timing estimated by the valve opening start timing calculation unit (1123) (S1605). When the first required value or the second required value is less than the predetermined threshold value, the actual valve opening time length calculation unit (1125) uses the valve opening start timing estimated by the valve opening start timing calculation unit (1123) as the valve opening start timing of the fuel injection valve (200) (S1604). The predetermined threshold value is set to be less than or equal to the value for fully opening the fuel injection valve (200). Therefore, the fuel injection valve (200) can be controlled by following the conventional control procedure in the full lift region and using the result of estimating the valve opening start timing according to the first embodiment in the half lift region.

The fuel injection control device (100) further includes the pulse width calculation unit (1126) which obtains the pulse width of the driving signal for controlling the switching elements (141, 142) supplying the driving current to the fuel injection valve (200). The pulse width calculation unit (1126) obtains the normal value of the pulse width according to at least one of the first required value, the second required value, and the fuel pressure of the fuel injection valve (200) (S1802). When the normal value is greater than or equal to a predetermined threshold value, the pulse width calculation unit (1126) uses the normal value as the pulse width of the driving signal (S1807). When the normal value is less than the predetermined threshold value, the pulse width calculation unit (1126) corrects the normal value using the difference between the actual valve opening time length and the target valve opening time length and uses the corrected value as the pulse width of the driving signal (S1806). Therefore, the fuel injection valve (200) can be controlled by following the conventional control procedure in the full lift region and using the result of estimating the valve opening start timing according to the first embodiment in the half lift region.

Second Embodiment

In the first embodiment, it has been described that the valve opening time length is controlled by controlling the driving pulse width for driving the switches 141 and 142. On the other hand, the pulse signal calculation unit 112 controls the pulse width in order to control the valve opening time length, and the waveform command unit 113 controls the peak value of the driving current or the like (302*a* to 302*c* in FIG. 3, etc.). Therefore, these may operate independently. The injection amount may reach the target value at the time earlier than the pulse falling timing calculated by the pulse signal calculation unit 112, depending on the command value from the waveform command unit 113. In the second embodiment of the present invention, an operation procedure in such a case will be described.

The fuel injection amount correlates with the valve behavior. Specifically, the target injection amount is achieved when a time integral S of the target injection valve behavior 831 and a time integral S' of the actual injection valve behavior 832*a* in FIG. 8 match each other. A time integral of the valve behavior further correlates with a time integral of the driving current of the fuel injection valve 200. Therefore, the waveform command unit 113 may cut off the driving current when the fuel injection amount reaches the target value, according to the following procedure.

A value obtained by converting the target valve opening time length into the current integral value is set as a target valve opening current integral value, and a value obtained by converting the actual valve opening time length into the current integral value is set as an actual valve opening current integral value. The waveform command unit 113 calculates the difference between the target valve opening current integral value and the actual valve opening current integral value. The waveform command unit 113 calculates a target current integral value of the fuel injection valve 200 based on this difference. The waveform command unit 113 calculates the current integral value by detecting the driving current during injection, for example, every 1 ms, and compares the current integral value with the target current integral value. The waveform command unit 113 cuts off the driving current when both match each other. A specific method for cutting off the driving current includes, for example, (a) lowering the current waveform (the peak value of the driving current), (b) lowering the driving pulse, (c) directly inputting the energization stop command to the driving IC 120.

When obtaining the above integral, the waveform command unit 113 does not necessarily have to strictly time-integrate the current waveform, and may obtain an approximate integral value. For example, the integral value of the driving current may be obtained by the approximate calculation using the peak value of the driving current and the timing at which the driving current or the driving pulse starts to fall. For example, the current waveform of FIG. 4 may be regarded as a right triangle and the time integral may be simply obtained.

In the first embodiment, it has been described that the driving pulse is controlled in order to align the fuel injection amount with the target value, but the driving current waveform may be controlled instead of or in combination with this. Specifically, the waveform command unit 113 may obtain the time integral of the driving current and control the driving current waveform so that the time integral approaches the target value.

Second Embodiment: Summary

The fuel injection control device (100) further includes the waveform command unit (113) which designates the current waveform of the driving current supplied to the fuel injection valve (200). The waveform command unit (113) designates the current waveform of the driving current so as to open the fuel injection valve (200) from the valve opening start timing estimated by the valve opening start timing calculation unit (1123) until the target valve opening time length of the fuel injection valve (200) is reached. Therefore, the injection amount of the fuel injection valve (200) can be controlled to the target value by controlling the driving current waveform in addition to or instead of the driving pulse width.

The waveform command unit (113) increases or decreases the time integral of the driving current to open the fuel injection valve (200) from the valve opening start timing estimated by the valve opening start timing calculation unit (1123) until the target valve opening time length of the fuel injection valve (200) is reached. Therefore, the injection amount of the fuel injection valve (200) can be controlled to the target value independently of the control of the driving pulse width.

The waveform command unit (113) increases or decreases the time integral of the driving current by changing at least one of the peak current value of the driving current or the timing at which the driving current starts to fall. Therefore, the time integral of the driving current can be easily obtained.

Modification of the Present Invention

The present invention is not limited to the above-described embodiments and various modifications can be made thereto. For example, the embodiments have been described in detail for easy understanding of the present invention and are not intended to limit to those necessarily including all the above-described configurations. In addition, a part of a configuration of a certain embodiment can be replaced with a configuration of another embodiment, and a configuration of another embodiment can be added to a configuration of a certain embodiment. Furthermore, it is possible to add, remove, or replace another configuration with respect to a part of a configuration of each embodiment.

In the above-described embodiments, it has been described that the difference between the valve opening start timing of the reference fuel injection valve and the valve opening start timing of the fuel injection valve 200 is obtained, but ratios of the two timings may be used instead of the difference. Similarly, in the second embodiment, these ratios may be used instead of the difference between the target valve opening current integral value and the actual valve opening current integral value.

All or part of the above-described configurations, functions, processing units, processing means, and the like may be realized by hardware, for example, design of integrated circuits or the like. In addition, each of the above-described configurations, functions, and the like may be realized by software which causes a processor to interpret and execute a program that realizes each function. Information of the programs, tables, files, and the like that realize each function can be stored in a memory device such as memory, hard disk, solid state drive (SSD), or a recording medium such as IC card or SD card. Furthermore, control lines or information lines indicate what is considered to be necessary for the description, and all the control lines or information lines are not necessarily shown on products. In practice, it can be considered that almost all the structures are mutually connected.

REFERENCE SIGNS LIST

100 fuel injection control device
110 microcomputer
111 engine condition detection unit
112 pulse signal calculation unit
113 waveform command unit
120 driving IC
130 high voltage generation unit
141 Hi switch
142 Lo switch
150 valve closing timing detection unit
200 fuel injection valve

The invention claimed is:

1. A fuel injection control device for controlling a fuel injection valve of an internal combustion engine, the fuel injection control device comprising:

a processor and a memory configured to estimate a valve opening start timing at which the fuel injection valve starts to open; and store reference data describing a characteristic of a reference fuel injection valve used as a reference when estimating the valve opening start timing; and a driving circuit configured to open the fuel injection valve by supplying a driving current to the fuel injection valve, wherein the processor and the memory are configured to estimate the valve opening start timing by referring to the reference data using a characteristic parameter representing the characteristic of the fuel injection valve, wherein the driving circuit lowers the driving current when a fuel injection amount by the fuel injection valve reaches a target value, wherein the processor and the memory are further configured to obtain an actual opening time length at which the fuel injection valve is opened, switch whether or not to obtain the actual valve opening time length using the valve opening start timing estimated by the processor and the memory according to at least one of a first required value for an injection amount of fuel injected by the fuel injection valve or a second required value for a pulse width of a driving signal for controlling a switching element supplying the driving current to the fuel injection valve, when the first required value or the second required value is greater than or equal to a predetermined threshold value, use a predefined timing as the valve opening start timing of the fuel injection valve instead of the valve opening start timing estimated by the processor and the memory, and wherein the predetermined threshold value is a value corresponding to a boundary between a full lift region and a half lift region.

2. The fuel injection control device according to claim 1, wherein the reference data describes a relationship between a reference characteristic parameter representing the characteristic of the reference fuel injection valve and a reference valve opening start timing at which the reference fuel injection valve starts to open, and the processor and the memory estimate the valve opening start timing by acquiring, from the reference data, the reference valve opening start timing corresponding to the characteristic parameter representing the characteristic of the fuel injection valve.

3. The fuel injection control device according to claim 2, wherein the processor and the memory are further configured to obtain the reference valve opening start timing using the reference data, and obtain a difference between the reference valve opening start timing and the valve opening start timing using the characteristics of the fuel injection valve, and estimate a timing, at which the fuel injection valve starts to open, according to the difference between the reference valve opening start timing and the valve opening start timing.

4. The fuel injection control device according to claim 2, wherein the reference data describes a relationship between the reference characteristic parameter and the reference valve opening start timing for each of a plurality of reference characteristic parameters, the processor and the memory are further configured to identify the reference characteristic parameter corresponding to the characteristic parameter and acquires, from the reference data, a difference between the valve opening start timing and the reference valve opening start timing corresponding to the identified reference characteristic parameter, and estimate the valve opening start timing by multiplying the difference by a weight determined for each reference characteristic parameter and adding the multiplying result to the reference valve opening start timing.

5. The fuel injection control device according to claim 1, wherein the processor and the memory are further configured to define a valve opening time length for opening the fuel injection valve, the processor and the memory define the valve opening time length so as to open the fuel injection valve from the valve opening start timing estimated by the processor and the memory until a target valve opening time length of the fuel injection valve is reached.

6. The fuel injection control device according to claim 5, further comprising switching elements which turn on/off the driving current supplied to the fuel injection valve, wherein the processor and the memory are further configured to calculate a pulse width of a signal for turning on the switching elements, and wherein the processor and the memory calculate the pulse width so as to open the fuel injection valve from the valve opening start timing estimated by the processor and the memory until the target valve opening time length of the fuel injection valve is reached.

7. The fuel injection control device according to claim 5, wherein the processor and the memory are further configured to designate a current waveform of the driving current supplied to the fuel injection valve, and the processor and the memory designate the current waveform of the driving current so as to open the fuel injection valve from the valve opening start timing estimated by the processor and the memory until the target valve opening time length of the fuel injection valve is reached.

8. The fuel injection control device according to claim 7, wherein the processor and the memory are further configured to increase or decrease a time integral of the driving current to open the fuel injection valve from the valve opening start timing estimated by the processor and the memory until the target valve opening time length of the fuel injection valve is reached.

9. The fuel injection control device according to claim 8, wherein the processor and the memory increase or decrease the time integral of the driving current by changing at least one of a peak current value of the driving current or a timing at which the driving current starts to fall.

10. The fuel injection control device according to claim 1, wherein the reference data describes a mechanical characteristic of the reference fuel injection valve, and the mechanical characteristic of the reference fuel injection valve is at least one of a stroke amount in which a mover included in the reference fuel injection valve moves from a time when the mover starts to move to a time when the reference fuel injection valve comes into contact with a valve body, a mass of the mover, a gap provided between the mover and the reference fuel injection valve in a portion in which the mover slides, and a spring load of a spring which moves the mover in a direction of closing the reference fuel injection valve.

11. The fuel injection control device according to claim 1, wherein the reference data describes an electrical characteristic of the reference fuel injection valve, and the electrical characteristic of the reference fuel injection valve is at least one of an electrical resistance of a coil which electromagnetically drives a valve body of the reference fuel injection valve, an inductance of the coil, and an effective value or a target value of a driving voltage supplied to the reference fuel injection valve.

12. The fuel injection control device according to claim 1, wherein the processor and the memory are further configured to when the first required value or the second required value is less than the predetermined threshold value, use the valve opening start timing estimated by the processor and the memory as the valve opening start timing of the fuel injection valve, the predetermined threshold value is set to be less than or equal to a value for fully opening the fuel injection valve.

13. The fuel injection control device according to claim 12, wherein the processor and the memory are further configured to obtain a pulse width of a driving signal for controlling a switching element supplying the driving current to the fuel injection valve, obtain a normal value of the pulse width according to at least one of the first required value, the second required value, and fuel pressure of the fuel injection valve, when the normal value is greater than or equal to a predetermined threshold value, use the normal value as the pulse width of the driving signal, and when the normal value is less than the predetermined threshold value, correct the normal value using a difference between the actual valve opening time length and a target valve opening time length and uses the corrected value as the pulse width of the driving signal.

* * * * *